US008459911B1

(12) United States Patent
Kim et al.

(10) Patent No.: US 8,459,911 B1
(45) Date of Patent: Jun. 11, 2013

(54) CARGO LOCKING MECHANISMS AND STRUCTURES

(75) Inventors: Robert M. Kim, Lyndhurst, NJ (US); Frank C. Chan, Parsippany, NJ (US); Robert J. Middleton, Ann Arbor, MI (US); Robert M. Forrester, Lake Hopatcong, NJ (US); Bryan Anderson, Andover, NJ (US); Robert H. Holt, Franklin, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 52 days.

(21) Appl. No.: 13/228,951

(22) Filed: Sep. 9, 2011

(51) Int. Cl.
*B60P 7/08* (2006.01)

(52) U.S. Cl.
USPC ..... 410/46; 410/32; 410/80; 410/84; 410/91

(58) Field of Classification Search
USPC .. 410/32, 33, 46, 80, 81, 84, 90, 91; 206/386, 206/596; 248/346.02, 346.03; 108/55.1, 55.3, 108/55, 5
See application file for complete search history.

(56) References Cited

U.S. PATENT DOCUMENTS 6,729,818 B1 * 5/2004 Yee et al. ..... 410/77
7,448,835 B1 11/2008 Forrester, Jr. et al.

* cited by examiner

*Primary Examiner* — Stephen Gordon
(74) *Attorney, Agent, or Firm* — Michael C. Sachs

(57) ABSTRACT

Locking mechanisms and assemblies for securing cargo to a transportation platform without requiring the use of strapping or equivalent. Advantageously, the locking mechanism may be integrated into a container such that each container may be interlocked with an underlying and/or overlying container. Autolocking variations to the locking mechanism provide a more automated, secure and less labor intensive way to secure cargo.

3 Claims, 10 Drawing Sheets

400

CARGO LOCKING MECHANISMS AND STRUCTURES

U.S. GOVERNMENT INTEREST

The inventions described herein may be manufactured, used and licensed by or for the U.S. Government for U.S. Government purposes.

FIELD OF THE DISCLOSURE

This disclosure relates generally to the field of cargo and/or material transport. More particularly, it pertains to an apparatus and structures for securing cargo and/or materials to transportation systems.

BACKGROUND OF THE DISCLOSURE

The transportation of cargo and/or material is a ubiquitous function in contemporary society. Associated with this transportation is the necessary function of securing the cargo and/or material to the transportation system/platform. Unfortunately, this securing of cargo and/or material oftentimes involves strapping or other systems which are labor intensive and frequently present significant safety concerns.

SUMMARY OF THE DISCLOSURE

An advance in the art is made according to an aspect of the present disclosure directed to a locking mechanism and structures for securing cargo and/or materials to a transportation system/platform.

Viewed from a first aspect, the present disclosure is directed to a locking mechanism for securing cargo to a transportation platform without requiring the use of strapping or equivalent. Advantageously, the locking mechanism may be integrated into a container such that each container may be interlocked with an underlying and/or overlying container.

Viewed from another aspect, the present disclosure is directed to an autolocking mechanism which allows the safe loading/unloading/securing of cargo to transportation systems and/or platforms using only forklift-type machinery. As a result, loading and unloading of cargo may be performed by only a single driver of the forklift without significant risk of injury. When configured having a form factor like that of a contemporary fork lift pallet or skid, the autolocking mechanism provides a pallet structure upon which cargo or other goods may be loaded and then conveniently loaded/unloaded. Advantageously, the autolocking mechanism according to the present disclosure secures all four corners of the pallet/container in which it is integrated, and permits the secure stacking of such palletized cargo.

BRIEF DESCRIPTION OF THE DRAWING

A more complete understanding of the present disclosure may be realized by reference to the accompanying drawings in which.

DETAILED DESCRIPTION

The following merely illustrates the principles of the disclosure. It will thus be appreciated that those skilled in the art will be able to devise various arrangements which, although not explicitly described or shown herein, embody the principles of the disclosure and are included within its spirit and scope.

Furthermore, all examples and conditional language recited herein are principally intended expressly to be only for pedagogical purposes to aid the reader in understanding the principles of the disclosure and the concepts contributed by the inventor(s) to furthering the art, and are to be construed as being without limitation to such specifically recited examples and conditions.

Moreover, all statements herein reciting principles, aspects, and embodiments of the disclosure, as well as specific examples thereof, are intended to encompass both structural and functional equivalents thereof. Additionally, it is intended that such equivalents include both currently-known equivalents as well as equivalents developed in the future, i.e., any elements developed that perform the same function, regardless of structure.

Thus, for example, it will be appreciated by those skilled in the art that the diagrams herein represent conceptual views of illustrative structures embodying the principles of the disclosure.

Figure 1:
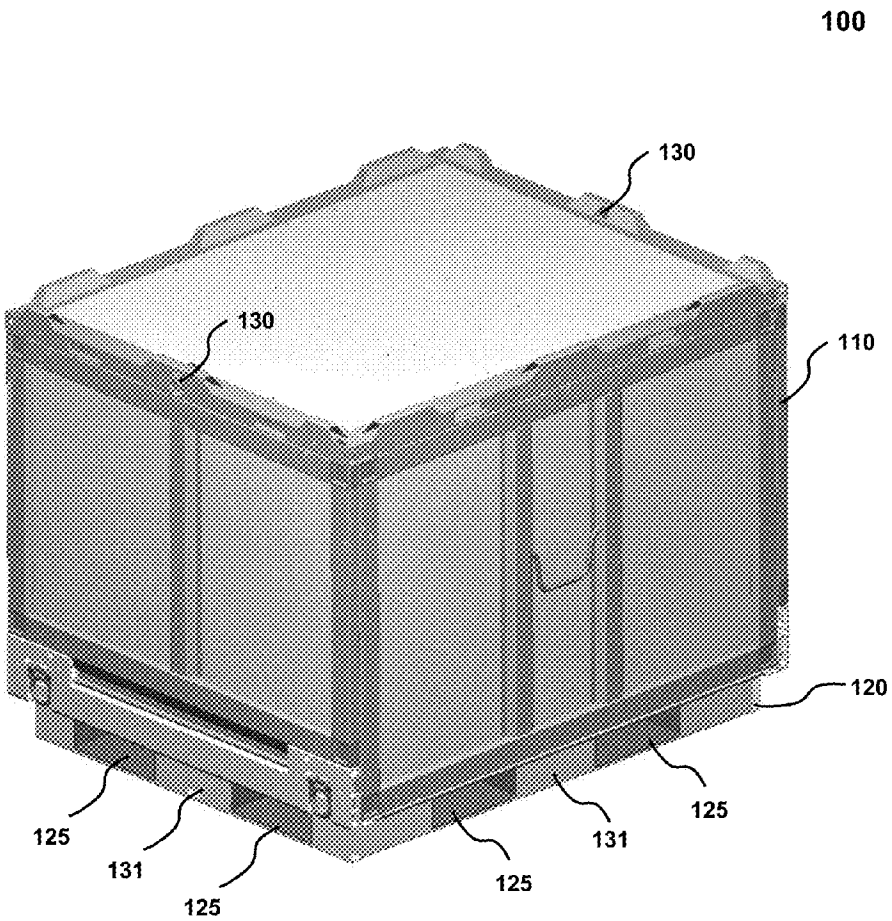
FIG. 1 is a schematic diagram showing a exemplary container with integrated pallet having an integrated manual locking mechanism according to an aspect of the present disclosure.

With reference now to FIG. 1, there is shown a schematic diagram of a representative palletized cargo container 110 having an integrated locking pallet 120 base according to an aspect of the present disclosure. As is known, a pallet—or oftentimes a skid—is a flat transport structure that supports goods in a stable manner while being lifted by a forklift, pallet jack, front loader or other jacking device. When goods are secured directly to a pallet, they are oftentimes secured with strapping, chains or even shrinkwrap. Advantageously, with the integrated container/pallet shown in FIG. 1, no strapping is required.

As is known and appreciated by those skilled in the art, a contemporary pallet (or fork lift pallet) is constructed from a number of wooden planks positioned upon stringers to create an integrated assembly. Such contemporary (wooden) pallets typically have two stringer sides and two lift sides—meaning that only two sides may receive the forks of the lift. With reference to the integrated container/pallet shown in FIG. 1, the structure is able to receive the forks of a lift on all four sides as fork pockets 125 are included on all four.

Notably, locking pins 131 are located in the center of the side portion of the pallet base 120 generally in the center of the two fork pockets 125. In this exemplary embodiment, the locking pins are normally withdrawn within the sides of the pallet until manually activated at which time they become extended from the sides of the pallet such that they may engage locking pin receivers (locking loops)—such as those shown as 130 on the top of the container.

As may be appreciated, when a modular container/pallet with integrated locking is positioned upon a transport surface having mating sets of locking pin receivers, the modular container/pallet may be secured to that transport surface by manually activating the locking pins 131 until they engage the mated locking pin receivers which are part of that transport surface.

Figure 2:
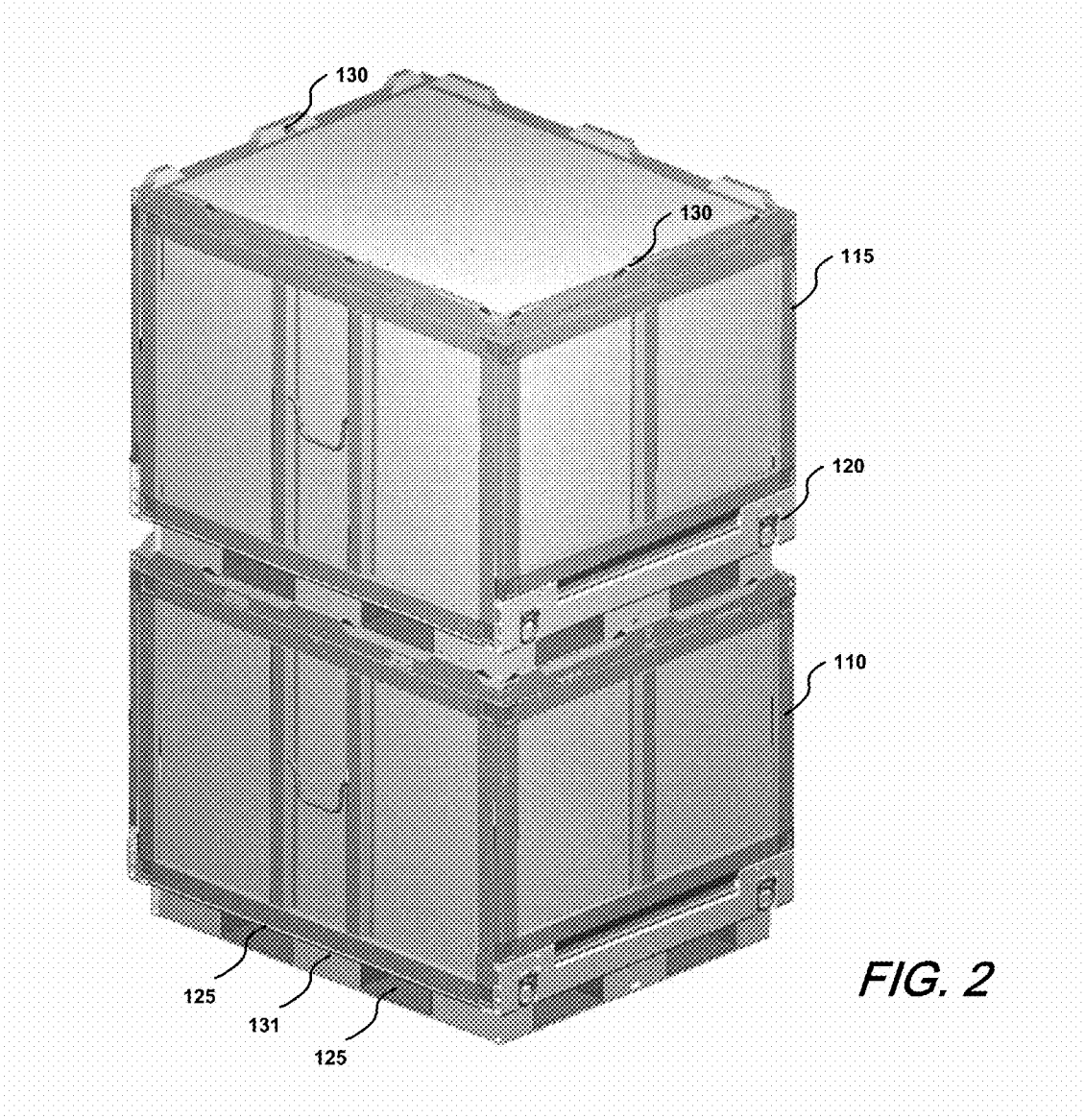
FIG. 2 is a schematic diagram showing stacked/locked containers of FIG. 1 according to an aspect of the present disclosure.

Similarly, a modular container/pallet with integrated locking may be stacked—one on another—wherein the lower modular container/pallet provides the locking pin receivers into which the locking pins of the top modular container/pallet are inserted. FIG. 2 shows such a stacked configuration wherein a top container 115 is stacked upon a lower container 110 and the locking pins of the upper container engage the locking pin receivers on the top of that lower container 110.

Figure 3A:
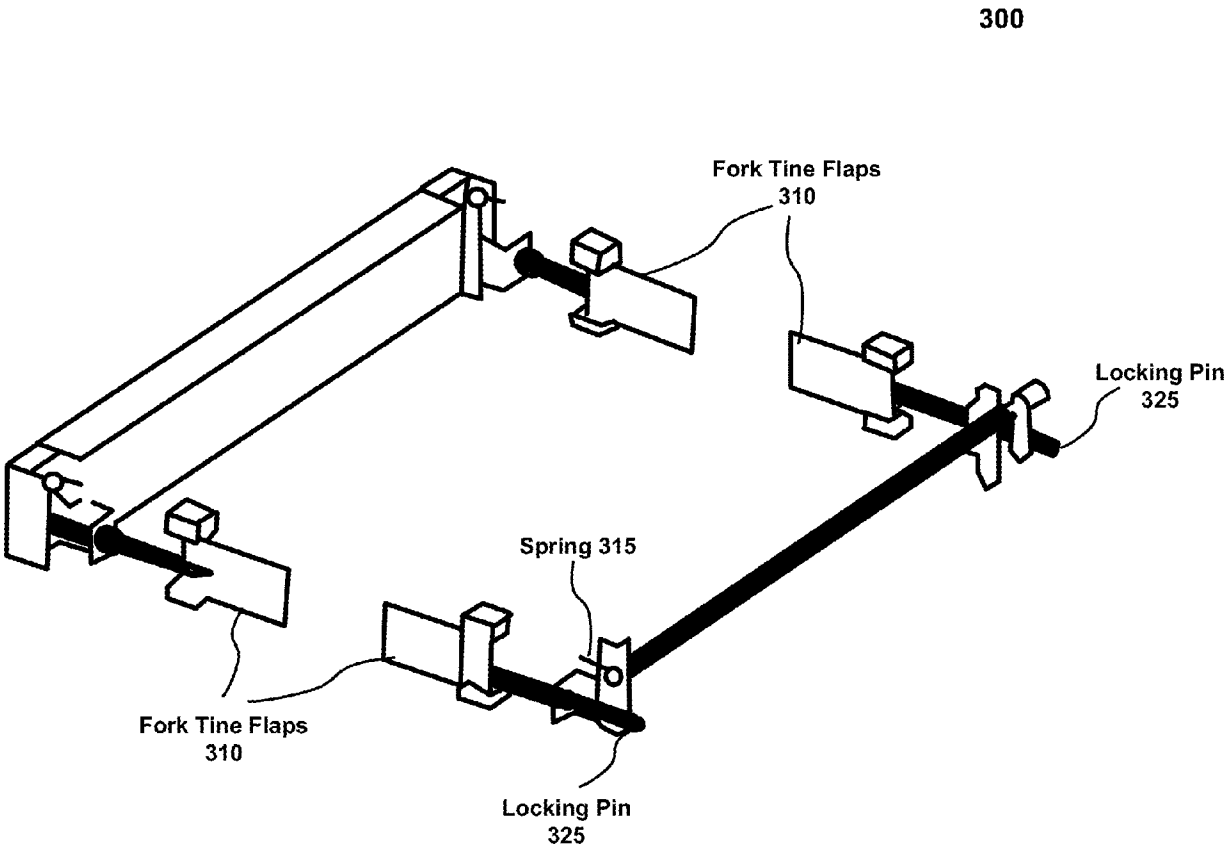
FIG. 3A is a schematic wireframe diagram showing an exemplary autolocking mechanism according to an aspect of the present disclosure.

FIG. 3A illustrates a schematic autolocking mechanism which may advantageously be integrated into a stand-alone pallet or integrated into a container/pallet such as that shown in FIG. 1 and FIG. 2. As shown, the autolocking mechanism includes two pair of fork tine flaps 310 each individual flap being connected to a locking pin 325 which is held in a normally extended (locked) position through the effect of a torsion or other spring 315. A connecting rod 320 connects a front set of tine flaps and locking pins to a rear set of fork tine flaps and locking pins.

Operationally, a locking pin 325 is located at each corner of the autolocking mechanism which in a preferred embodiment may be configured and exhibit the same form factor as a conventional fork lift pallet. Each of the locking pins 325 is connected to a flap 310. As may be understood and appreciated from this FIG. 3, when the forks of a lift are inserted into fork pockets and engage the fork tine flaps—by pushing them inward toward the center in preparation to lift the pallet—the lock pins 325 are withdrawn and unlock. The connecting rod 320 provides the rotational and translational forces necessary to withdraw the lock pins on the opposite side of the pallet. In this inventive manner, when the fork tines engage the flaps on a particular side and unlock the pins the autolocking mechanism and its load will be freed for lifting.

Similarly, when a load positioned upon a pallet (with an autolocking mechanism according to the present disclosure) is placed at a desired location and the fork tines are removed from the fork pockets, the fork tine flaps 310 re-orient under urging by the spring 315 such that the locking pins 325 are extended and therefore capable of engaging locking pin receivers such as those shown in FIG. 1 with respect to the modular container/pallet. Not specifically shown in these figures are a manual override mechanism which permits an operator to engage the flaps and secure them into position such that the locking pins are withdrawn.

Figure 3B:
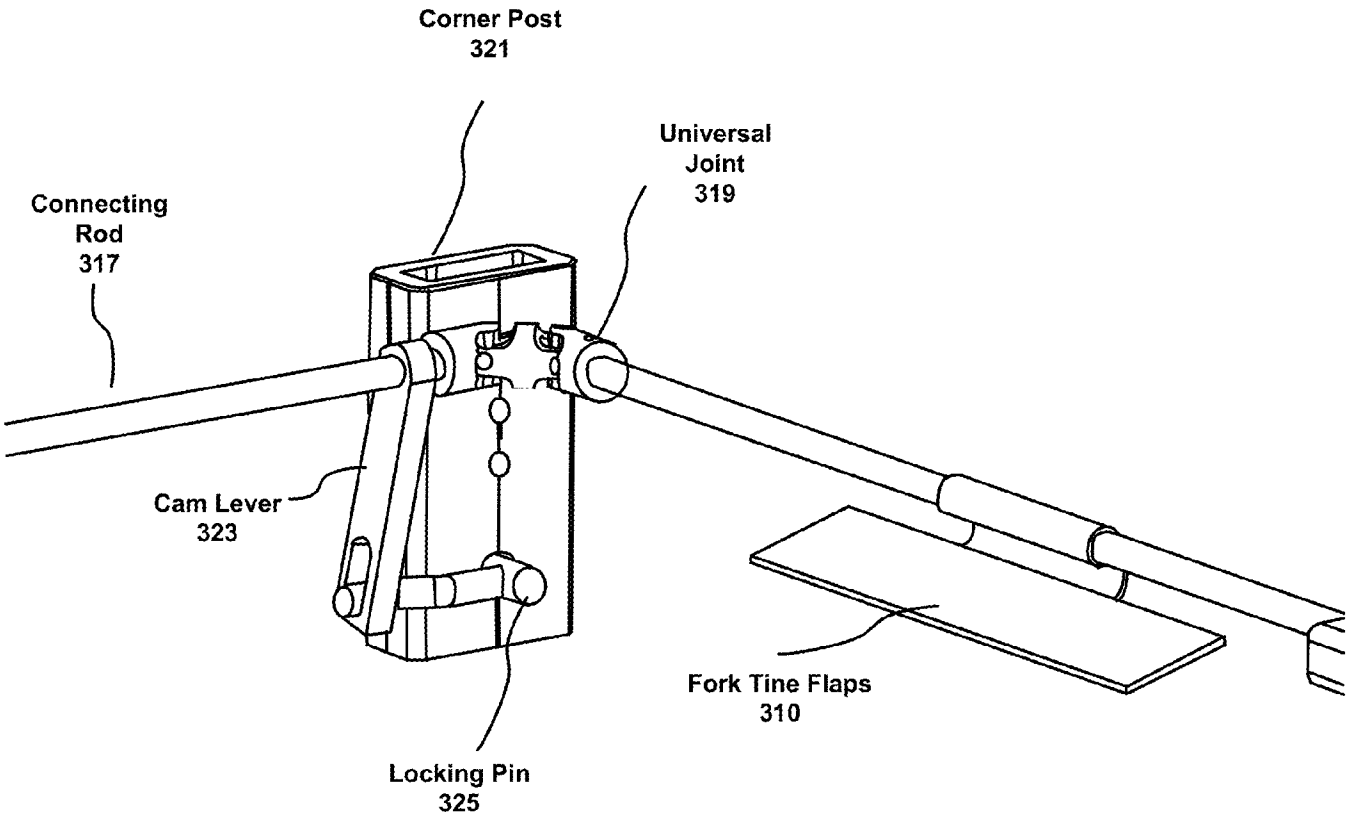
FIG. 3B is a schematic wireframe diagram showing a corner, connecting rod, universal joint and paddle configuration of an alternate, exemplary autolocking mechanism according to an aspect of the present disclosure.

FIG. 3B shows an alternate configuration of an autolocking system according to a further aspect of the present disclosure. More particularly, the system of FIG. 3B employs "flip up" fork tine flaps 310 and universal jointed (or other compatible 90 degree transfer mechanism) with a connecting rod to transfer the flip up movement of the flaps to the locking pins. As with the embodiment shown previously, when a fork lift fork flips the flaps, all four locking pins located at each corner of the system are withdrawn and the pallet system is released for movement. Conversely, when the system is placed and the fork lift forks are withdrawn from the fork lift pockets, the fork tine flaps 310 are returned to their normal position through the effect of springs and the locking pins are extended thereby securing the system in place.

Figure 4A:
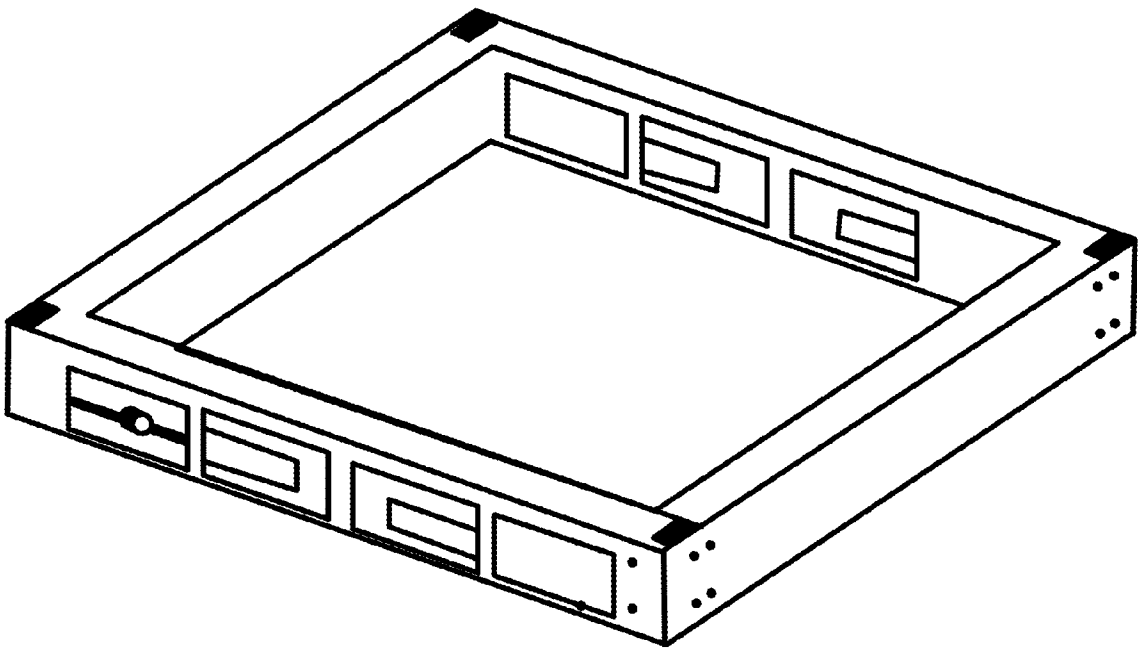
FIG. 4A is a schematic wireframe diagram showing a pallet base having an integrated autolocking mechanism according to an aspect of the present disclosure.
Figure 4B:
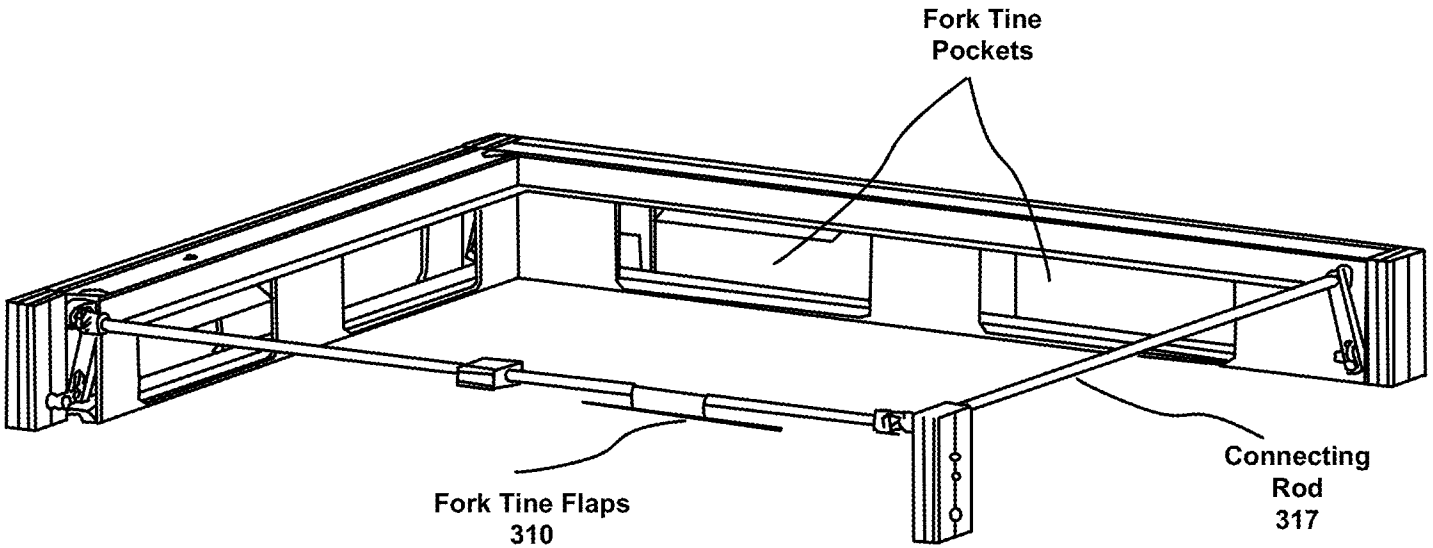
FIG. 4B is a schematic wireframe diagram showing a pallet base having the alternate integrated autolocking mechanism of FIG. 3B according to an aspect of the present disclosure.

FIGS. 4A-4B shows a schematic of a representative pallet base 400 configuration with integrated autolocking mechanism according to the present disclosure. As shown here in FIGS. 4A-4B, the pallet base configuration of the autolocking mechanism exhibits a form factor preferably corresponding to a contemporary fork lift pallet. In this manner, the pallet base configuration may be employed in situations previously performed by contemporary wooden pallets and further configured as an autolocking pallet to which is attached a container, or cargo. As may be observed here in FIGS. 4A-4B, fork tine paddles are contemporary wooden pallets and further configured as an autolocking pallet to which is attached a container, or cargo. As may be observed here in FIGS. 4A-4B, fork tine paddles are visible in fork tine pockets within pallet. Consequently, when fork tines are inserted into the fork tine pockets the autolocking mechanism is activated and locking pins (not specifically shown in this figure) are withdrawn into the pallet for removal.

Figure 5:
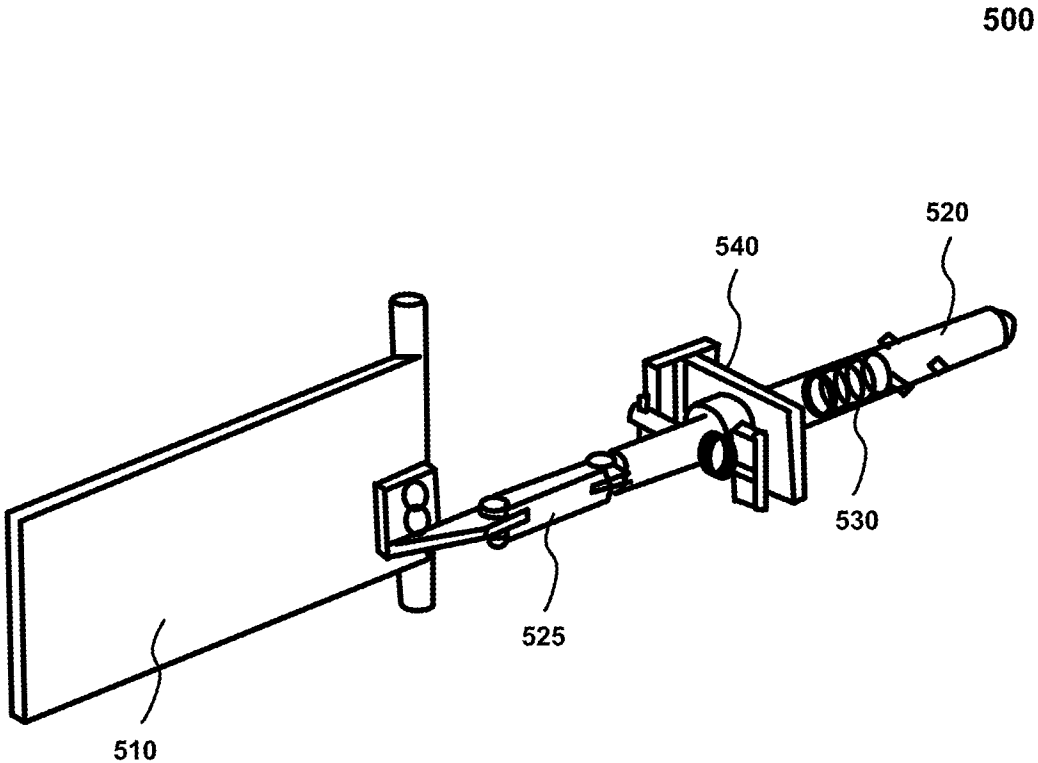
FIG. 5 is a schematic diagram showing a perspective view of the autolock mechanism according to an aspect of the present disclosure.

FIG. 5 is a schematic perspective diagram of an autolock assembly 500 according to an aspect of the present disclosure. In particular, the autolock assembly comprises a flap 510, pivot-ably attached to locking pin rod 520 by linkage 525. Springs 530 which apply force to bracket 540 maintain the locking pin 520 in an extended position. Operationally when the flap is rotated (by a fork lift tine for example) it results in a translational movement of the locking pin 520 such that it is withdrawn. When the flap 510 is released (the fork lift tines is removed) the spring 530 urges the flap to a normal, closed position and the locking pin is extended.

Figure 6:
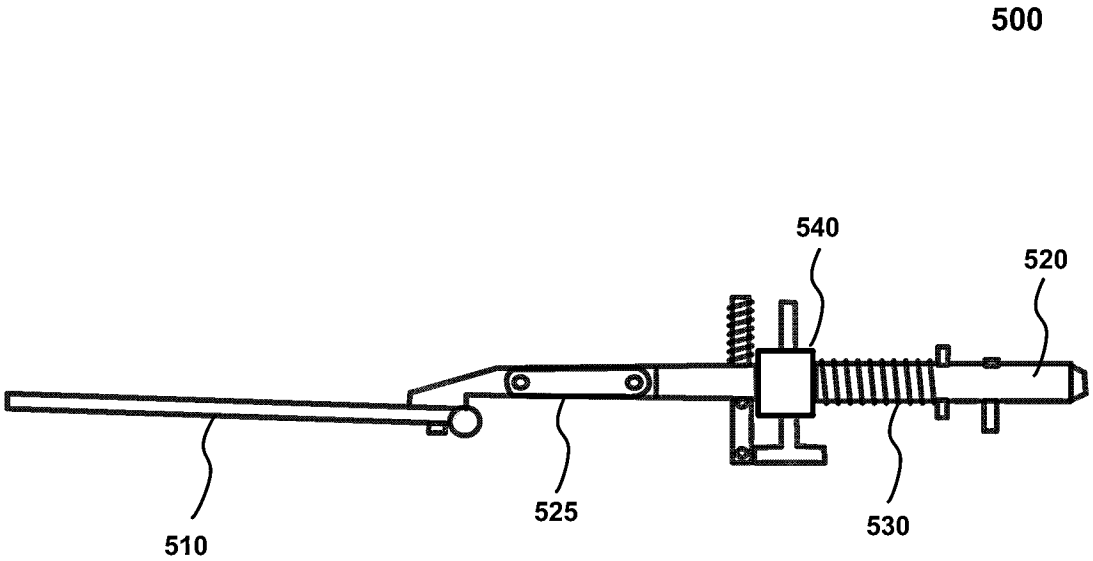
FIG. 6 is a schematic diagram showing a bottom view of the of the autolock mechanism according to an aspect of the present disclosure.

FIG. 6 is a schematic diagram showing a bottom view of the autolock assembly shown in FIG. 5. Shown in FIG. 6 are flap 510 pivot-ably attached to the locking pin rod 520 by linkage 525. Spring 530 applies force at one end to the locking pin 520 and to the other end to bracket 540 such that the locking pin is in a normally extended position and aligned with the flap 510.

Figure 7:
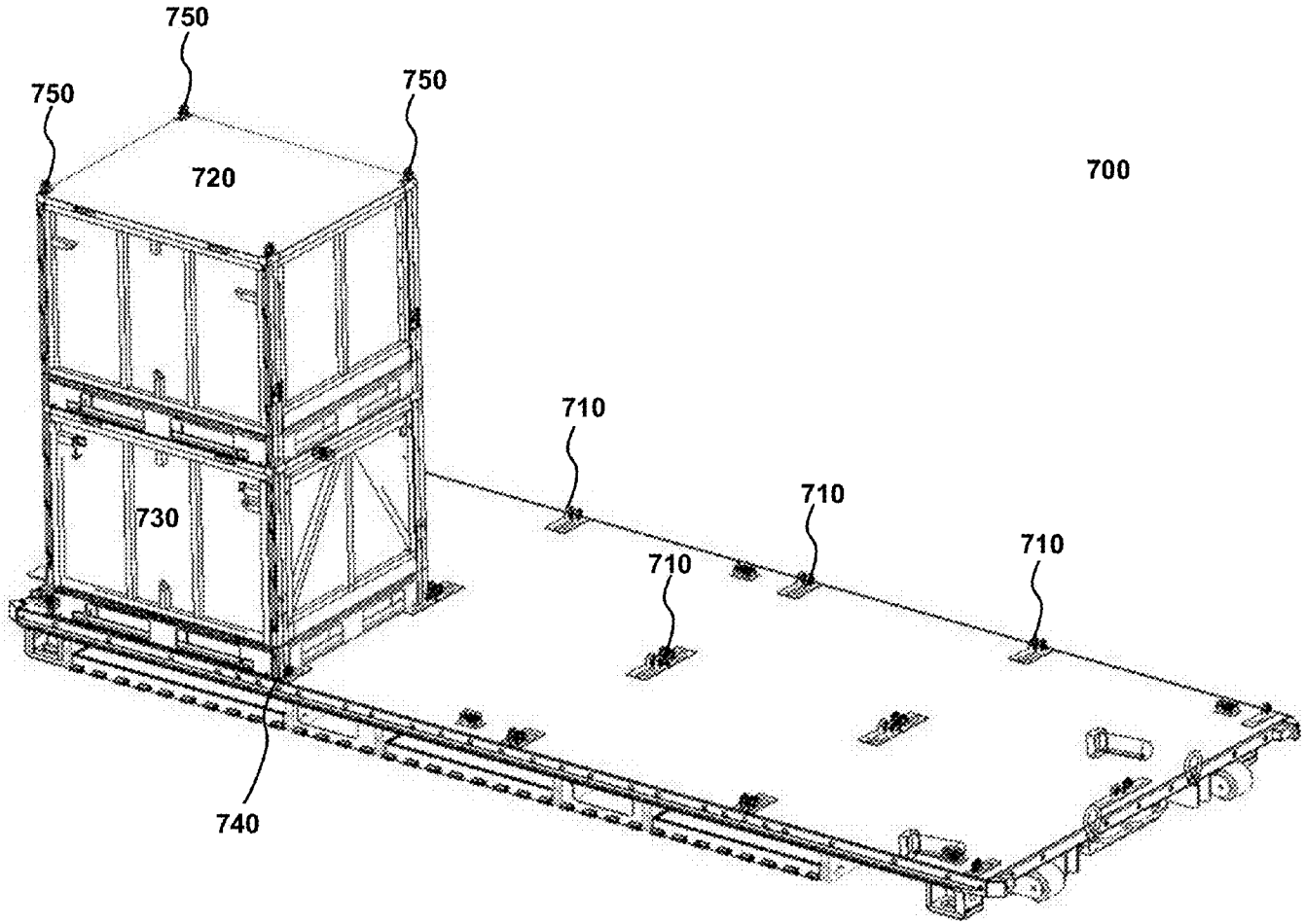
FIG. 7 is a schematic diagram showing a cargo platform for carrying autolocked cargo according to an aspect of the present disclosure.

Turning now to FIG. 7, there shown a cargo platform suitable for use with pallet base autolocking assemblies such as those shown and described. As shown in the FIG. 7, the cargo platform includes a series of locking pin receivers (locking loops) 710 which are spaced to receive the locking pins of the autolocking assemblies previously described. As such, when cargo—positioned upon a pallet base autolocking assembly 720, 730—is aligned with and positioned upon the locking pin receivers the locking pins 740 of the assembly engage the receivers and secure the assembly and the cargo to the platform. Advantageously, and as can be readily appreciated, such a configuration assures uniform loading and facilitates balancing of the load upon the platform while positively securing the load to the platform.

In a preferred embodiment, the present disclosure is implemented as a Container Roll in/out Platform (CROP). As is known, conventional CROP structures are approximately a 20' by 8' platform that is primarily used in conjunction with the Army Load Handling System (LHS). The LHS is typically mounted on a large transportation truck, and can lift the CROP from the ground onto the back of the truck for transport. This system is designed for typically moving palletized or general cargo. Specifically, this platform is the prime mover for all of the US Army's ammunition in tactical settings.

A king Modular Intermodal Container (JMIC) (such as the container shown as 730, 730 in FIG. 7) is a standardized container with standardized lockdown points. Each JMIC has four receptacles for lockdown points (740), one under each base corner. These receptacles accept a standardized ring-shaped protrusion in a standardized pattern. Additionally, in this preferred embodiment, each includes four lockdown points on top (750) for stacking one container onto another and securing. Advantageously, the autolocking mechanism of the present disclosure facilitates this stacking and locking as can be viewed from this FIG. 7.

Currently, these two systems to not interact in any sort of mechanical fashion. The JMICs can be transported on the CROP utilizing traditional tiedown procedures, which does not make use of their unique interlocking features, is time-consuming, and can pose safety concerns.

The CROP-JMIC Interlock System when integrated with the autolocking mechanism of the present disclosure advantageously combines these systems into a surprisingly easy to use overall system.

In this preferred embodiment, the interlock loops are positioned in groups of four such that they match the required footprint of the JMIC. Furthermore, groups of four interlocks are spread out such that they make a 2×4 grid on the top surface of the CROP, allowing for the placement of 8 JMICs on the top surface of the CROP. Of course, those skilled in the art will appreciate that additional JMICs—including the autolocking system of the present disclosure—may be stacked/locked upon the top surfaces of these JMIC containers secured to the top surface of the CROP. In this manner, a secure stack of JMICs may be assembled and transported without any additional tie-down or strapping.

Of additional interest, the interlocks (locking loops/receiving loops) are all foldable such that they fold down flat when not in use thereby returning the surface of the CROP returns to a flat, usable surface.

Figure 8:
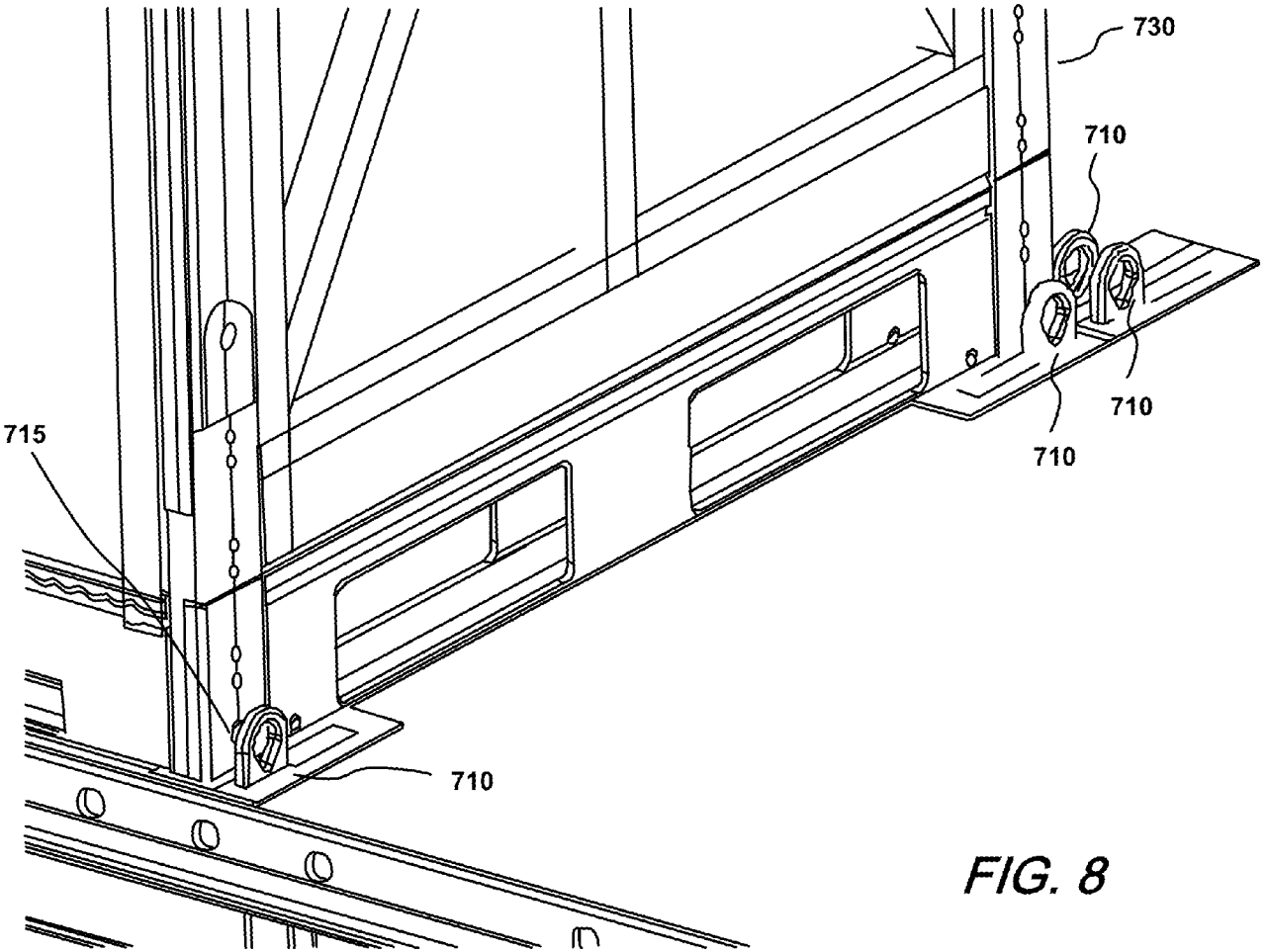
FIG. 8 is a schematic diagram showing an autolocked cargo container and platform receiving loops according to an aspect of the present disclosure.

The locking loops receiving loops 710 are shown in a more detailed view in FIG. 8. As shown in the figure, when a container 730 with integrated autolock system according to the present disclosure is in position, each of the corners of the container 730 are proximate to a locking loop 710. In this manner, when the container system is positioned with a fork truck or the like, and the fork truck is withdrawn, the four locking pins 715 will engage the locking loops adjacent to the pins and secure the system in place.

At this point, while we have discussed and described the autolocking assembly and configurations thereof it is noted that variations to those disclosed are contemplated. Accordingly, the scope of the disclosure should be only limited by the claims attached hereto.

The invention claimed is:

1. A locking cargo system comprising:

a platform having a plurality of foldable, locking loops disposed upon a top surface, said locking loops being spaced to receive a container;

a container, having a pallet base including a number of fork-tine pockets and corners, said pallet base including an autolocking mechanism comprising a number of spring-loaded locking pins, one of said locking pins disposed at each corner of the base, said locking pins being horizontally movable with respect to the base, said locking pins being horizontally movable to engage the locking loops thereby securing the entire base, wherein said locking pins are in a normal-extended position to engage the complementary ones of the locking loops and a number of paddles, said locking pins being pivotably connected to the paddles, wherein upon movement of the paddles, the pins are withdrawn into the base thereby freeing the base from the platform.

2. The locking cargo system of claim 1 wherein said locking mechanism further comprises a connecting rod for connecting a set of said locking pins to another set of said locking pins on an opposite side of the locking mechanism such that when any of paddles are depressed, all of the locking pins are withdrawn into the locking mechanism.

3. The locking cargo system of claim 2, wherein said container with said pallet base includes a plurality of locking loops at top corner portions of the container such that additional containers may be positioned on top of the container and secured to that container via respective locking pins and respective locking loops.

* * * * *